US005715687A

United States Patent [19]

Nienaber et al.

[11] Patent Number: 5,715,687

[45] Date of Patent: Feb. 10, 1998

[54] DOUBLE LAYER COOLER

[75] Inventors: Bernd Nienaber, Ahlen; Hermann Niemerg, Ennigerloh; Gunter Driemeier, Lienen, all of Germany

[73] Assignee: Krupp-Polysius AG, Beckum, Germany

[21] Appl. No.: 444,708

[22] Filed: May 19, 1995

[30] Foreign Application Priority Data

Jun. 6, 1994 [DE] Germany ..... 44 19 729.2

[51] Int. Cl.[6] ..... F25D 17/00

[52] U.S. Cl. ..... 62/57; 62/63; 62/374; 432/77

[58] Field of Search ..... 62/63, 57, 374; 432/77, 78

[56] References Cited

U.S. PATENT DOCUMENTS 3,831,291 8/1974 Kayatz ..... 432/78

4,762,489 8/1988 Schmits et al. ..... 432/77

FOREIGN PATENT DOCUMENTS 1097346 1/1961 Germany .

*Primary Examiner*—Ronald C. Capossela

*Attorney, Agent, or Firm*—Learman & McCulloch

[57] ABSTRACT

A double layer cooler for particulate material has a conveyor to which separate streams of such material are delivered at spaced intervals to form lower and upper layers of material on the conveyor. As the layers move toward the discharge end of the conveyor a coolant passes upwardly through the layers. At the discharge end of the conveyor the material of the lower layer is discharged, whereas the material of the upper layer passes over a stationary quantity of material to a crusher in which the upper layer material is crushed. From the crusher material is returned to that stream which forms the lower layer on the conveyor. The lower layer of material thus is precooled and comminuted.

22 Claims, 4 Drawing Sheets

DOUBLE LAYER COOLER

Figure 1:
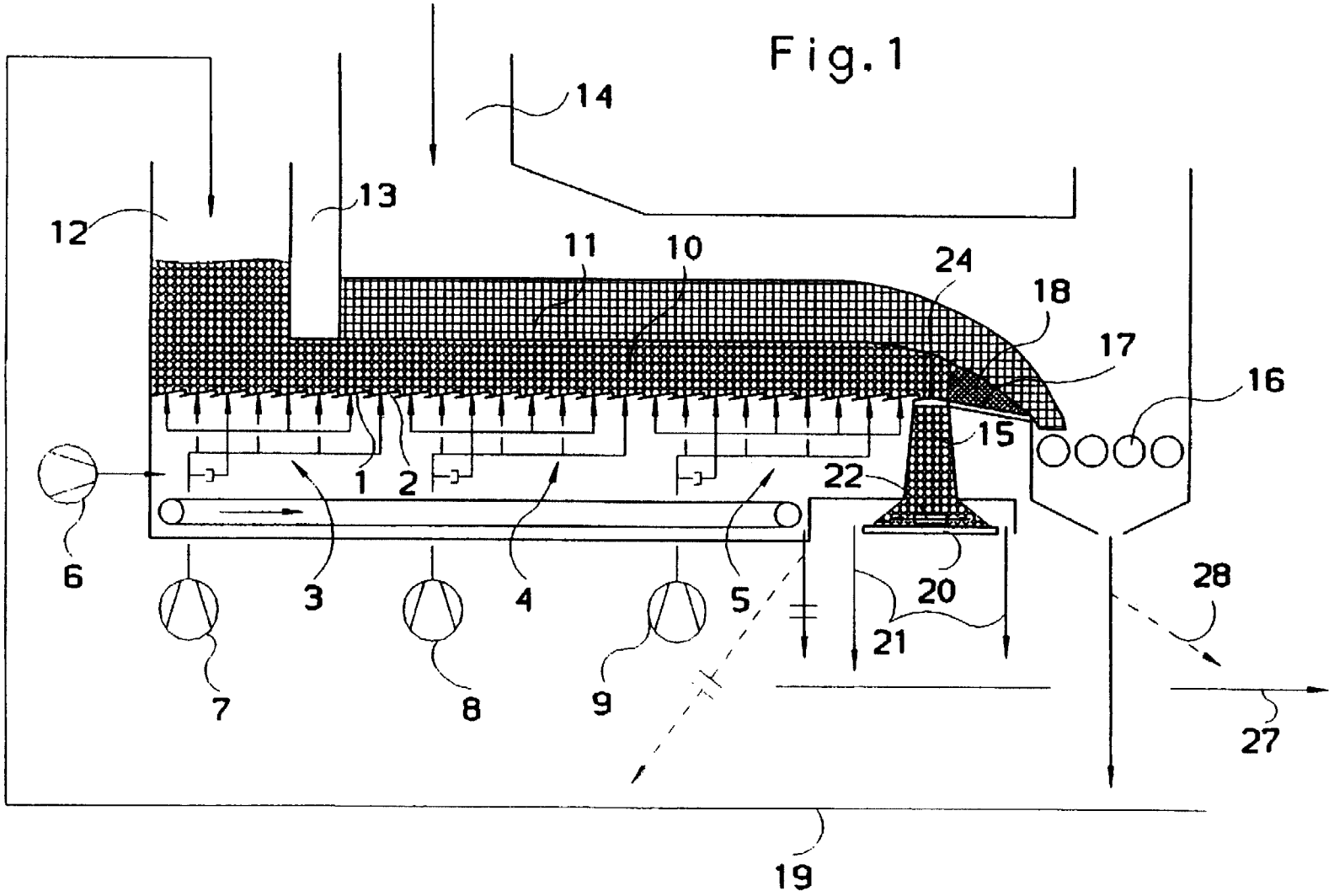

The invention relates to a double layer cooler, in which an upper layer of hot material, to be cooled is fed onto a lower layer of material which has already been procooled and at the end of the cooler the two layers are separated from one another so that the material of the lower layer is drawn off as finished material and the material of the upper layer passes through a crusher and returned to the cooler as the lower layer.

BACK GROUND OF THE INVENTION

A double layer cooler of the aforementioned generic type is known For example from DE-C-1 097 346. In this known cooler a blade-like mechanical cutter is disposed at the end of the discharge cooler for separating the upper and lower layers.

The essential disadvantage of such a construction lies in the high mechanical and thermal wear to which the cutter is exposed when it dips into the hot material. In the known construction this results in considerable expenditures on maintenance and equally very undesirable susceptibility to breakdown.

SUMMARY OF THE INVENTION

The object of the invention, is to provide a double layer cooler of the type mentioned so that in the region of separation of the layers the freedom from maintenance and the security against breakdown of the apparatus are substantially improved.

This object is achieved according to the invention in that a flat material support is provided upstream of the crusher, such support being so inclined that it supports a stationary quantity of material which forms the separating means for separating the upper and lower material layers.

Since in the construction according to the invention the separating means is formed not by a separate mechanical element but by a stationary quanitity of material, the wear which is unavoidable in the region of the separating means occurs solely between particles of material which are moved relative to one another. However, such abrasion—unlike wear of a mechanical cutter—is in no way disruptive, since the resulting fine material particles are drawn off with the finished material and the sationary quanitity of material is regenerated automatically from the newly delivered stream of material.

THE DRAWINGS

Figure 2:
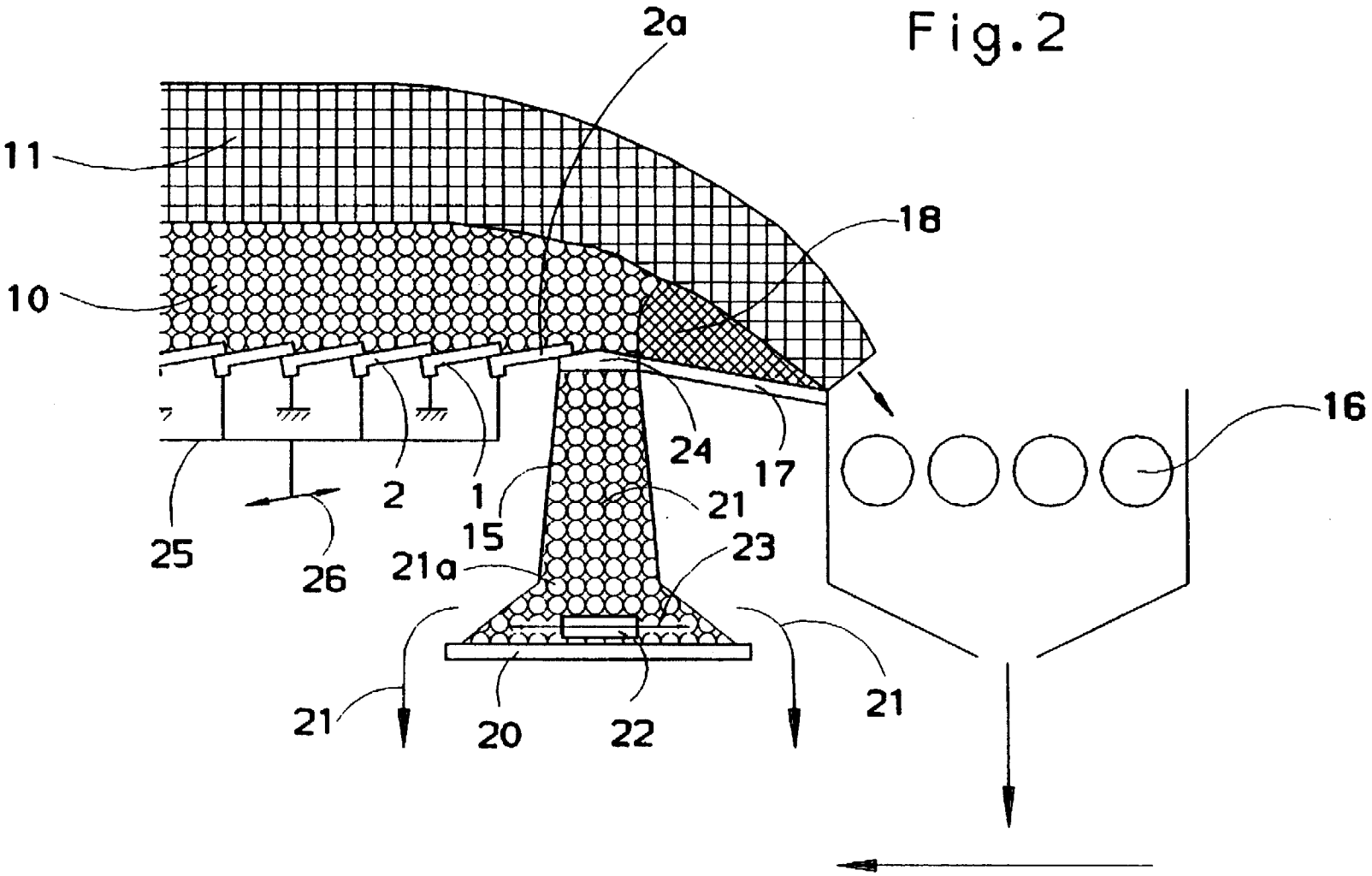
Figure 3:
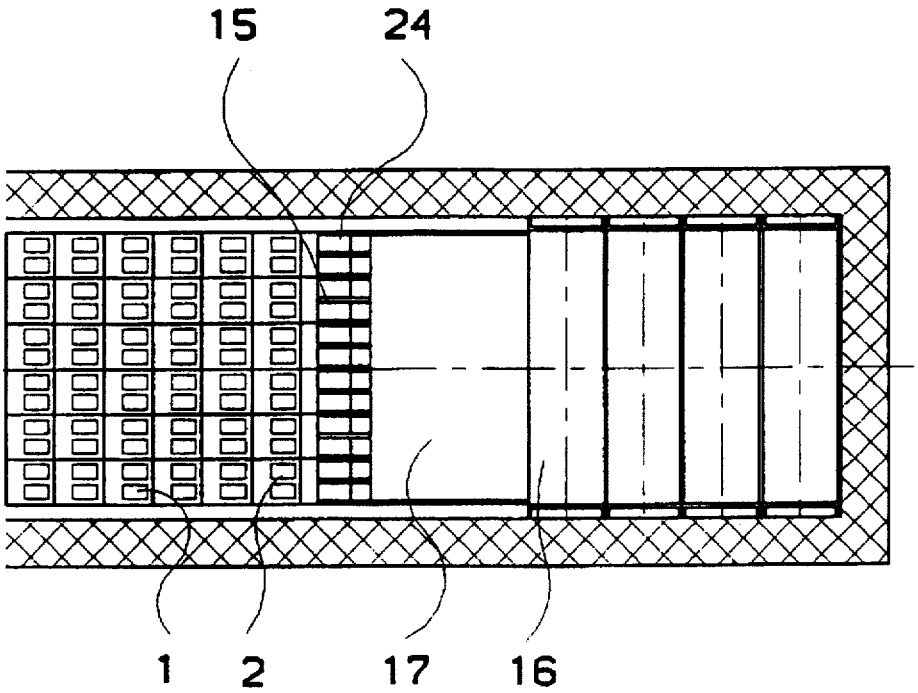
Figure 4:
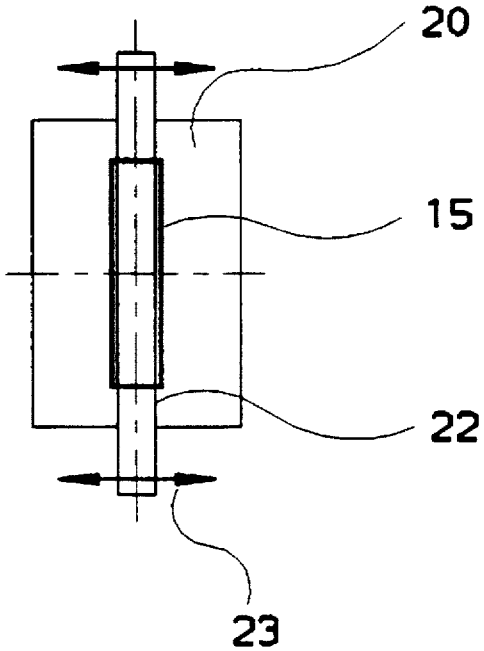
Figure 5:
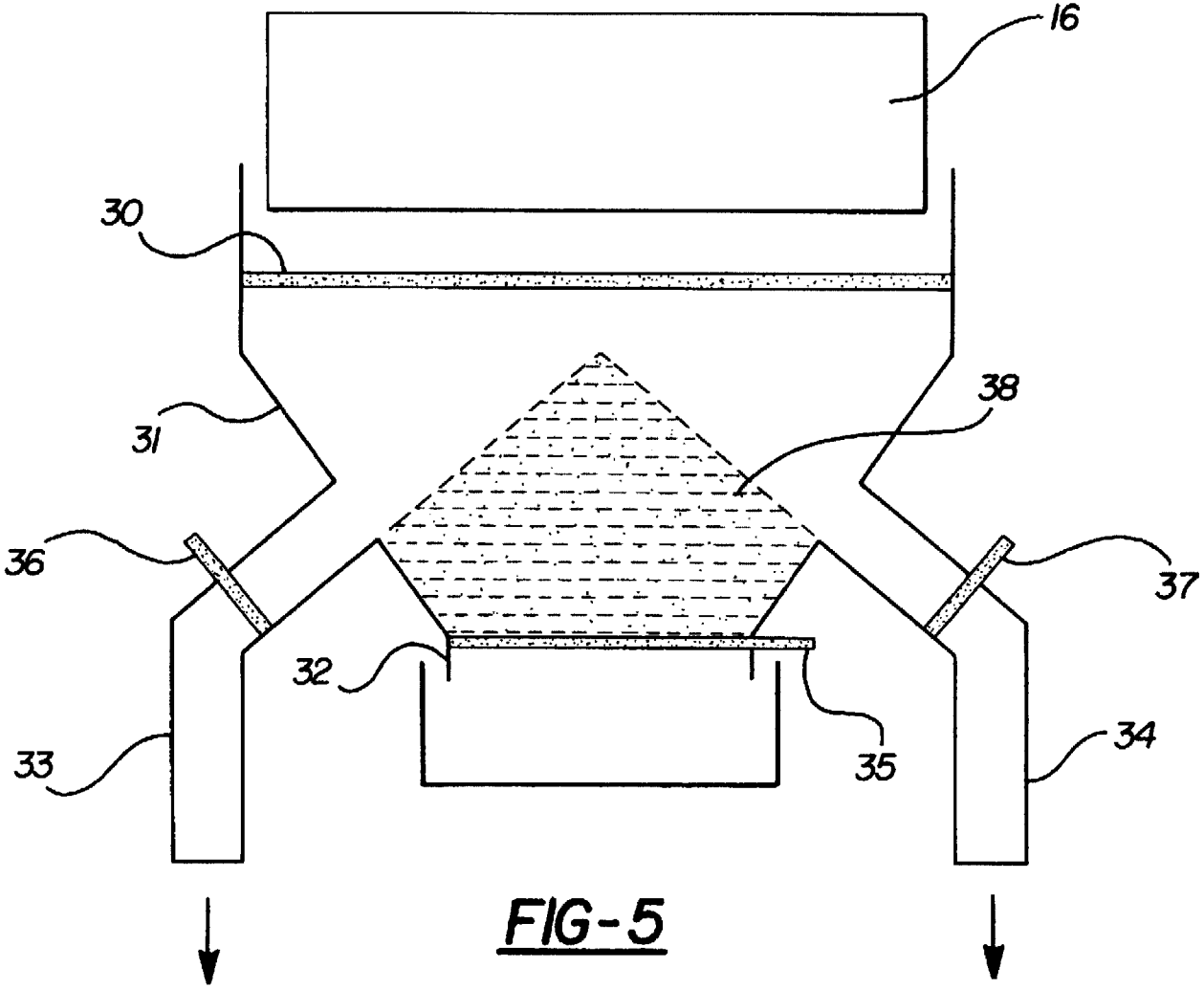

These and further features of the invention are set out in the following description of an embodiment which is illustrated in the drawings wherein:

FIG. 1 shows a schematic overall view of a double layer cooler according to the invention, FIG. 2 shows a partial view of the elements, which are essential for the invention, at the discharge end of the double layer cooler according to FIG. 1, FIG. 3 shows a plan view or the end of the cooler, FIG. 4 shows a plan view of the finished material shaft baffle surface and discharge device, FIG. 5 shows a schematic detail of a variant of the recirculated material discharge.

THE PREFERRED EMBODIMENTS

The double layer cooler which is shown in FIG. 1 in a schematic overall view is constructed as a reciprocating grate cooler, with successive rows of plates 1, 2 disposed so as to be alternately stationary and movable.

The rows of plates of the cooler are assembled into several groups 3, 4, 5 which are separately supplied with cooling air by way of fans 6 and 7 or 8, 9 respectively.

At the inlet end of the cooler a lower layer 10 of material to be cooled and which has already been precooled is fed onto the grate surface of the cooler. An upper layer 11 of hot material to be cooled is brought onto this lower layer 10. The precooled material of the lower layer 10 is delivered by way of a first shaft 12 which is separated longitudinally of the conveyor by a bunker wall 13 from a second shaft 14 through which the hot material—coming for example from a rotary kiln—is fed onto the lower layer 10 of the double layer cooler.

At the discharge end of the cooler a finished material shaft 15 is provided for drawing off the material of the lower layer 10, and this finished material shaft will be explained in greater detail with the aid of FIGS. 2, 3 and 4.

Downstream of discharge end of the cooler is a crusher 16 which is preceded by a stationary support chute 17 which delivers the material of the upper layer 11 to the crusher 16. This chute 17 is flat and inclined downwardly in the direction of material flow so that a zone 18 forms on it. The stationary material zone constitutes separating means which at the discharge end of the cooler separates the layers 10 and 11 from one another by holding back the material of the lower layer 10 and guiding it into the finished material shaft 15, whilst the material of the upper layer 11 can slide over the resting material zone 18 so that it reaches the crusher 16.

Coarser pieces of material of the upper layer 11 are crushed by the crusher 16. After passing through the crusher 16 the material or the upper layer 11 is delivered to a conveyor 19 and transported as recirculated, precooled material to the inlet end of the cooler and is there fed as the lower layer 10 onto the grate surface of the cooler.

The lower end of the finished material shaft 15 opens at a distance above a baffle surface 20 which is formed by a horizontally disposed table. The dimensions thereof and the distance thereof from the lower end of the finished material shaft 15 are chosen so that the bulk material cone 21*a* of the finished material 21 coming out of the finished material shaft 15 opens on the surface of the table forming the baffle surface 20 and is confined within the rims of the table.

A known discharge device 22 is movable to and fro along the baffle surface 20 in the direction or the double arrow 23. The stroke speed and the stroke length of this discharge device 22, which is constructed as a beam, are variable.

The inlet opening of the finished material shaft 15 at the upper end of the shaft is covered by a classifier 24 constructed as a screen or grate.

The finished material shaft 15 extends over the entire width of the cooler (cf. FIG. 3). Its cross-section widens downwards (cf. FIG. 2).

As FIG. 2 shows, the grate plates of the movable rows of plates 2 are supported by a movable frame which is movable to and fro in the direction of the double arrow 26, whilst the plates of the rows of plates 1 are stationary.

The last movable row of plates 2*a* in the direction of conveying is disposed so that it at least partially covers the classifier 24.

Portions of the movable rows of plates 2 can be connected to a channel which moves with the movable frame 25 and is supplied with air by way of a sliding seal.

The finished material 21 which is discharged by the discharge device 22 to both sides over the front and rear rim of the baffle surface 20 is delivered for further transport by a conveyor 27. If required, a part of the material of the upper layer 11 can be admixed with the finished material as indicated at 28 after passing through the crusher 16.

Grate riddlings which fall down between the grate plates and the fixed and movable rows of plates 1, 2 are passed by a transport conveyor 29 either to the conveying line 27 or the finished material or to the conveying line 19 of the recirculated material.

The operation of the double layer cooler should be readily understandable from the following explanations:

The lower layer 10 of material which has already been precooled protects the grate surface of the cooler from an excessive thermal load as well as from severe wear by the hot material which forms the upper layer 11.

At the discharge end of the cooler the two layers are separated by the separating means formed by the chute 17 and the stationary material theron. An alteration in the thickness of the upper and lower layers on the conveyor is possible by adjustment of the vertical position. Thus for example the height of the the stationary material zone 18 (and thus the thickness of the lower layer 10) can be increased by reducing the inclination of the chute 17 and vice versa). Naturally, within the scope of the invention other constructions are possible for influencing the relative thickness of the upper and lower layers. The relative layer thickness can also be influenced for example by raising or lowering the chute 17 (with the inclination of the chute remaining constant).

The classifier 24 provided at the upper end of the finished material shaft 15 holds back larger lumps of material which are present in the lower layer 10. These lumps of material are then either subjected to autogenous crushing in the material of the lower layer above the classifier 24, or they pass into the resting material zone 18 or into the upper layer 11. In the latter case they pass again through the crusher 16.

The finished material 21 is baffled on the baffle surface 20 since the bulk material cone 21 opens on the surface of the table forming the baffle surface 20 inside the rims or the table. Therefore independently of the particular grain size composition of the finished material 21—which may change during operation—the discharged quantity of material is determined exclusively by the stroke speed and the stroke length of the discharge device 22.

The invention was explained above using the example of a reciprocating grate cooler. However, naturally, it can also be used advantageously in other double layer coolers, particularly in double layer travelling grate coolers.

The last movable row of plates 2*a* of the cooler has elongated thrust edges so that the screen bars of the classifier 24 are swept over completely or partially. As a result, even when large pieces of deposit enter the region of the classifier 24, at least the region swept over by the last movable row of plates is always kept free during the return stroke. This region is of such large dimensions that the quantity of material of the lower layer 10 goes through.

The screen bars of the classifier 24 prevent large pieces or material from entering the finished material shaft 15. In this way a blockage between the lower end of the finished material shaft 15 and the table forming the baffle surface 20 is avoided.

The discharge device 22 constructed as a beam is driven mechanically or hydraulically. It is advantageously protected against wear by cast elements.

The two part-streams of finished material 21 which are conveyed away from the baffle surface 20 by the discharge device 22 can either—as indicated in FIG. 1—be brought together to one common conveying line 27 or can be separately transported further.

FIG. 5 shows in a variant an advantagetous embodiment of the arrangements disposed downstream of after the crusher 16 for discharging the recirculated material (i.e. the material of the upper layer 11).

Downstream of the crusher 16 there is disposed a bar screen 30, the openings of which are or such dimensions that material to be cooled which has been crushed by the crusher passes through the bar screen, but larger foreign bodies (for example broken rings of the crusher 16) are held back.

Connected to the bar screen 30 is a chute 31 which has a main outlet 32, which delivers the recirculated material (conveying line 19 according to FIG. 1) to a transport arrangement, as well as two bypass outlets 33, 34. Through the two last-mentioned bypass outlets 33, 34 cooling material from the upper layer 11 can be drawn off as required as finished material. It then passes according to the conveying line 28 (according to FIG. 1) into the conveying line 27 or the finished material.

The three outlets 32, 33 and 34 can be opened or closed as required by slide plates 35 to 37.

The bypass outlets 33, 54 are at the same time emergency routes in the event or failure of a transport arrangement for the recirculated material.

In normal operation the bypass outlets 33, 34 are basically closed.

If the slide gates 36, 37 are opened and the slide gate 35 closed, then the cooler can also be operated with one layer if so desired. In this case a cone 38 of stationary material is supported in the chute by the slide gate 35.

We claim:

1. A double layer cooler construction comprising a material conveyor having an inlet end and a discharge end for moving material in a direction from said inlet end toward said discharge end; first material delivery means for delivering material to be cooled to said conveyor adjacent said inlet end to form a lower layer of said material on said conveyor; second material delivery means downstream of said first delivery means for delivering material to said conveyor to form an upper layer of said material on said lower layer; a discharge chute adjacent said discharge end of said conveyor for receiving the material of said lower layer; and stationary support means downstream from said discharge chute for supporting a quantity of material at rest and over which material of said upper layer passes, said stationary support means and the material supported thereon effecting separation of said upper and lower layers.

2. The construction according to claim 1 wherein said stationary support means is vertically adjustable.

3. The construction according to claim 1 wherein said stationary support means is inclined to the horizontal.

4. The construction according to claim 2 or 3, wherein said stationary support means is inclined downwardly in the direction of movement of said material by said conveyor.

5. The construction according to claim 1 including crusher means downstream of said conveyor for receiving and crushing material discharged from said upper layer.

6. The construction according to claim 5 including transport means for transporting crushed material from said crusher means to said first delivery means.

7. The construction according to claim 5 or 6 including classifying means downstream of said crusher means for separating relatively larger and relatively smaller particles of crushed material.

8. The construction according to claim 7 including a receiver downstream of said crusher means for receiving crushed material, said receiver having a main outlet opening for crushed material and at least one bypass outlet opening, and means for selectively adjusting the openings of said outlets.

9. The construction according to claim 1 including material receiving means beneath said discharge chute for receiving material from said discharge chute, and discharge means for discharging material from said receiving means.

10. The construction according to claim 9 wherein said receiving means comprises a horizontal table having a material support surface the dimensions of which and the distance below the discharge chute are such that the material supported on said surface is wholly within the confines of said surface.

11. The construction according to claim 10 wherein said discharge means is reciprocable across said table surface.

12. The construction according to claim 11 wherein said discharge means has an adjustable length stroke and rate of reciprocation.

13. The construction according to claim 1 wherein said discharge chute extends from side to side the full width of said conveyor.

14. The construction according to claim 13 wherein said discharge chute has a cross section which widens downwardly.

15. The construction according to claim 1 including classifying means overlying said discharge chute for separating relatively larger and relatively smaller particles of the material of said lower layer.

16. The construction according to claim 15 wherein said conveyor comprises a reciprocating grate conveyor having alternate stationary and movable grates, that grate adjacent said discharge chute being reciprocable through a distance sufficient to sweep at least a portion of said classifying means.

17. A method of cooling hot particulate material comprising delivering first and second separate streams of said material to a material conveyor at intervals spaced longitudinally of said conveyor to form lower and upper layers respectively of said material on said conveyor; moving said layers of material simultaneously by said conveyor toward a discharge end of said conveyor; passing coolant upwardly through said layers as they move toward the discharge end; removing material from the lower layer at the discharge end of said conveyor; supporting a stationary quantity of said material downstream from the discharge end of said conveyor; and discharging the material of said upper layer from said conveyor across said stationary quantity of material.

18. The method according to claim 17 including crushing the material of said upper layer after such material traverses said stationary quantity of material.

19. The method according to claim 18 including separating relatively coarse and relatively fine particles downstream of said crusher.

20. The method according to claim 17 or 18 including returning the discharged material of said upper layer to said first stream of material.

21. The method according to claim 17 including adjusting the thickness of the stationary quantity of material to a selected dimension.

22. The method according to claim 17 including adjusting the thickness of the lower and upper layers on the conveyor by adjusting the thickness of the stationary quantity of material.

* * * * *

UNITED STATES PATENT AND TRADEMARK OFFICE

CERTIFICATE OF CORRECTION

PATENT NO. : 5,715,687

DATED : February 10, 1998

INVENTOR(S) : Bernd Nienaber, Hermann Niemerg, Gunter Driemeier

It is certified that error appears in the above-indentified patent and that said Letters Patent is hereby corrected as shown below:

Column 1, line 45, change "sationary" to -- stationary --; line 58, change "or" to -- of --.

Column 2, line 20, after "of" (first occurrence) insert -- the --; line 33, change "or" to -- of --; line 46, change "or" to -- of --.

Column 3, line 7, change "or" to -- of --; line 39, change "or" to -- of --.

Column 4, line 5, cancel "after"; line 9, change "or" to -- of --; line 20, change "or" to -- of --; line 24, change "54" to -- 34 --; line 25, change "or" to -- of --; line 32, after "chute" insert -- 31 --.

Signed and Sealed this

Twenty-first Day of April, 1998

Bruce Lehman

*Attest:*

BRUCE LEHMAN

*Attesting Officer*

*Commissioner of Patents and Trademarks*